US012540381B2

(12) United States Patent
Tosone et al.

(10) Patent No.: US 12,540,381 B2
(45) Date of Patent: Feb. 3, 2026

(54) METHOD FOR HARDENING A SHEET OR STRIP MADE OF AN ALUMINUM ALLOY, AND SHEET OR STRIP PRODUCED USING SAID METHOD

(71) Applicant: AMAG ROLLING GMBH, Braunau am Inn—Ranshofen (AT)

(72) Inventors: Ramona Tosone, Neukirchen an der Enknach (AT); Florian Schmid, Graz (AT); Stefan Pogatscher, Leoben (AT); Peter J. Uggowitzer, Ottenbach (CH)

(73) Assignee: AMAG ROLLING GMBH, Braunau am Inn— Ranshofen (AT)

( * ) Notice: Subject to any disclaimer, the term of this patent is extended or adjusted under 35 U.S.C. 154(b) by 348 days.

(21) Appl. No.: 17/999,590

(22) PCT Filed: May 27, 2021

(86) PCT No.: PCT/EP2021/064291
§ 371 (c)(1),
(2) Date: Nov. 22, 2022

(87) PCT Pub. No.: WO2021/239919
PCT Pub. Date: Dec. 2, 2021

(65) Prior Publication Data

US 2024/0417838 A1 Dec. 19, 2024

(30) Foreign Application Priority Data

May 27, 2020 (EP) ..... 20176943

(51) Int. Cl.
*C22F 1/043* (2006.01)
*C22C 21/02* (2006.01)
*C22F 1/00* (2006.01)

(52) U.S. Cl.
CPC ..... *C22F 1/043* (2013.01); *C22C 21/02* (2013.01); *C22F 1/002* (2013.01)

(58) Field of Classification Search
None
See application file for complete search history.

(56) References Cited

U.S. PATENT DOCUMENTS 5,728,241 A * 3/1998 Gupta ..... C22F 1/057 148/698
2017/0044650 A1 2/2017 Harrison et al.

FOREIGN PATENT DOCUMENTS

JP 2011038136 A 2/2011
JP 2013060627 A 4/2013

OTHER PUBLICATIONS

G Mrowka-Nowotnik; "Influence of chemical composition variation and heat treatment on microstructure and mechanical properties of 6xxx alloys", Archives of Materials Science and Engineering, Bd. 46, Nr. 2, 2. Dec. 2010; 10 pages.

(Continued)

*Primary Examiner* — George Wyszomierski
*Assistant Examiner* — Janell C Morillo

(57) ABSTRACT

The invention relates to a method for hardening a sheet or strip made of an aluminum alloy of the 6xxx row and to a sheet or strip produced using said method. In order to accelerate the hardening method, a multistage thermal treatment is proposed which includes a process of maintaining a second holding temperature (T2) ranging from 150 to 250° C. for a second holding time (h2) and a subsequent second accelerated cooling process, wherein the second holding process together with the subsequent second accelerated cooling process interrupts the first holding process multiple times, thereby dividing the first holding process into holding stages, in each case at a first holding temperature (TI)

(Continued)

ranging from 60 to 140° C. and for a first holding time interval (hIa, hIb, hIc, hId, hIe) which lasts longer than the second holding time (h2).

12 Claims, 1 Drawing Sheet

(56) References Cited

OTHER PUBLICATIONS

International Search Report for PCT Application No. PCT/EP2021/064291, dated Aug. 17, 2021; 5 pages.
Takata et al.; "Improvement of Strength-Elongation Balance of Al—Mg—Si Sheet Alloy by Utilising Mg—Si Cluster and Its Proposed Mechanism"; Materials Transactions, vol. 58, No. 5 (2017) pp. 728 to 733.

* cited by examiner

METHOD FOR HARDENING A SHEET OR STRIP MADE OF AN ALUMINUM ALLOY, AND SHEET OR STRIP PRODUCED USING SAID METHOD

FIELD OF THE INVENTION

The invention relates to a method of hardening a sheet or strip made of an aluminum alloy of the 6xxx series and a sheet or strip produced thereby.

DESCRIPTION OF THE PRIOR ART

It is known from the prior art (cf. Ken Takata et Al., "Improvement of Strength-Elongation Balance of Al—Mg—Si Sheet Alloy by Utilising Mg—Si Clusters and Its Proposed Mechanism", Materials Transactions (2017)) to improve elongation at break and tensile strength values in Al—Mg—Si aluminum alloys of the 6xxx series by subjecting the aluminum alloy to a substantially Mg—Si cluster-forming heat treatment after solution annealing and accelerated cooling (water quenching). This is carried out, for example, at a holding temperature of 100° C. (degrees Celsius) for a holding time of 24 days, which is a comparatively long process time, particularly with regard to industrial production.

With higher holding temperatures, the process time can be reduced, for example at 180° C. to 8 to 10 hours. Disadvantageously, at such higher holding temperatures, essentially β" precipitates form, which means that the combination of elongation at break and tensile strength values known from heat treatments with reduced holding temperatures cannot be achieved.

SUMMARY OF THE INVENTION

The invention has therefore set itself the object of improving a method of the type described at the outset in such a way that the process time for hardening with heat treatment at comparatively low holding temperatures can be reduced while maintaining virtually the same elongation at break and tensile strength values.

Since the heat treatment comprises a second holding at a second holding temperature in the range of 150 to 250° C. during a second holding time as well as a subsequent second accelerated cooling, it can initially be expected that—as is known for heat treatments at higher holding temperatures—process times are reduced on the one hand, but on the other hand a worse combination of elongation at break and tensile strength values results due to β" precipitations.

However, the latter can be specifically avoided by the provision for interrupting the first holding, since the second holding with subsequent second accelerated cooling interrupts the first holding several times and thereby divides this first holding into holding stages, each at a first holding temperature in the range of 60 to 140° C. and during a first holding time section lasting longer than the second holding time.

With the aid of the interrupting second holding in conjunction with the second accelerated cooling, a comparatively high number of additional vacancies can be generated and quenched in the 6xxx alloy, which supports Mg—Si cluster formation during the subsequent first holding and thus significantly reduces the process time of hardening under first holding.

According to the invention, therefore, those elongation at break and tensile strength values can be achieved significantly faster for 6xxx aluminum alloys (i.e. AlMgSi alloys of the 6000 series) which are known to be achieved during hardening with a formation of essentially Mg—Si clusters under comparatively long process times.

In general, it is mentioned that accelerated cooling can be understood as a faster cooling than cooling at room temperature and still air (cf. Friedrich Ostermann, Anwendungstechnologie Aluminium (Application Technology Aluminum), 3rd edition, year of publication 2014: Cooling after solution annealing).

Preferably, the first holding temperature is in the range of 80 to 120° C. in order to still be able to ensure a comparatively high Mg—Si cluster formation in the 6xxx aluminum alloy at shorter first holding time intervals. The above can be further improved by a first holding temperature in the range of 90 to 110° C.

The first holding time stages are preferably less than or equal to 12 hours in order to utilize substantially all of the quenched vacancies to form Mg—Si clusters. Preferably, the first holding time periods are in the range of 2 to 8 hours to thereby utilize a sufficient number of quenched vacancies to form Mg—Si clusters. The above can be further improved by first holding time sections in the range of 3 to 6 hours.

If the second holding temperature is in the range of 170 to 230° C., a temperature range can be specified in which a high number of vacancies can be advantageously produced, taking into account a comparatively short second holding time with reduced tendency to β" precipitations. The above can be further improved by a second holding temperature in the range of 190 to 210° C.

Preferably, the second holding time of the second holding is less than or equal to 15 minutes in order to provide sufficient vacancies with low precipitation tendency in the 6xxx alloy.

The method for hardening the 6xxx alloy can be further improved if the second holding time (h2) in seconds at average crystal grain size (KG), measured by the line intersection method ASTM E112, in microns and at second holding temperature (T2) in degrees Celsius satisfies the following conditions:

$$h2 \geq (A1 + B1 \cdot KG) \cdot \exp\left(-\frac{T2}{C1}\right) + (D1 + E1 \cdot KG)$$

$$h2 \leq (A2 + B2 \cdot KG) \cdot \exp\left(-\frac{T2}{C2}\right) + (D2 + E2 \cdot KG)$$

with the following parameters

A1=−26400, B1=5000, C1=22.00, D1=1.25 and E1=0.15

A2=−125000, B2=29700, C2=20.75, D2=−0.55 and E2=0.65

Since the average crystal grain size (KG) does not change substantially after the first accelerated cooling, this average crystal grain size can be measured at any time after the first accelerated cooling. For example, the average crystal grain size (KG) may be after the first accelerated cooling and before the first or second holding.

Preferably, the first holding temperatures are the same throughout the first holding. Preferably, multiple or all first holding time stages are the same. Preferably, the multiple second holding at a second holding temperature during a second holding time is the same. Preferably, the first holding time stage of the first holding time stages lasts longer than the subsequent first holding time stages.

In particular, the first and/or second accelerated cooling is carried out at a cooling rate of at least 20° C./s, in particular of at least 50° C./s, preferably of at least 80° C./s, so as to be able to reliably quench the vacancies formed during the second holding.

Preferably, heating from the first holding to the second holding occurs at a heating rate of at least 10° C./s, in particular at least 50° C./s.

Preferably, the 6xxx aluminum alloy has from 0.2 to 1.5 wt. % magnesium (Mg) and from 0.2 to 1.5 wt. % silicon (Si)—which can result in a large precipitation pressure for the formation of Mg—Si clusters during the first holding and an increased vacancy density during the second holding.

Optionally, the 6xxx aluminum alloy may contain one or more elements: up to 1.1 wt. % copper (Cu) and/or up to 0.7 wt. % iron (Fe) and/or up to 1.0 wt. % manganese (Mn) and/or up to 0.35 wt.-% chromium (Cr) and/or up to 0.25 wt. % zinc (Zn) and/or up to 0.15 wt. % titanium (Ti) and/or up to 0.1 wt. % vanadium (V) and/or up to 0.2 wt. % zirconium (Zr) and/or up to 0.2 wt. % tin (Sn).

The remainder of the aluminum alloy comprises aluminum and unavoidable impurities due to the manufacturing process, each in an amount of not more than 0.05 wt. % and in total not more than 0.15 wt. %.

In addition, the aluminum alloy may have from 0.2 to 1.2 wt. % magnesium (Mg) to further increase the formation of Mg—Si clusters.

Preferably, the aluminum alloy is of type AA6005, AA6016, AA6061, AA6063 or AA6082.

Preferably, the sheet or strip has a thickness of less than 5 mm, in particular 3 mm, in order to create a sufficient number of empty spaces with the brief interruption of the first holding and to prevent undesired precipitation.

Furthermore, the invention has set itself the object of creating a sheet or strip subjected to hardening with comparatively high elongation at break and tensile strength values.

By subjecting the sheet or strip to the hardening process according to the invention, a sufficiently high 0.2% yield strength $R_{p0,2}$>200 MPa and a sufficiently high elongation at break A of >20% can be achieved, this with substantially Mg—Si clusters in the aluminum matrix.

Preferably, the aluminum alloy has a cluster density of at least $2\times10^{24}$ clusters/$m^3$ with a Guinier radius >1 nm (nanometer) and with a median Guinier radius of >1.3 nm as measured by a LEAP 3000 HR type atom probe tomography (LEAP).

Preferably, the width of the precipitation-free zones at the grain boundaries is between 3 and 80 nm (nanometers) in order to limit a negative influence on the elongation values of the sheet or strip—even more so if the width of the precipitation-free zones at the grain boundaries is between 5 and 50 nm.

Preferably, the Mg- and Si-containing precipitates, in particular of the type $Mg_2Si$, have an average size of 30 to 100 nm (nanometers) at the grain boundaries in order to be able to ensure sufficient strength at high elongation values—this in particular if the precipitates have an average size of 50 to 70 nm at the grain boundaries.

DETAILED DESCRIPTION OF THE PREFERRED EMBODIMENTS

To demonstrate the effects obtained, rolled semi-finished products, namely sheets A, B and C formed as thin sheets, each with a sheet thickness of 1.7 mm (millimeters) and an AA6016 aluminum alloy with

| Mg wt. % | Si wt. % | Cu wt. % | Fe wt. % | Mn wt. % | Zn wt. % | Ti wt. % | Cr wt. % |
|---|---|---|---|---|---|---|---|
| 0.65 | 1.16 | 0.17 | 0.17 | 0.10 | 0.04 | 0.02 | 0.04 |

and the remainder aluminum as well as impurities unavoidable during production, each with a maximum of 0.05 wt. % and a maximum total of 0.15 wt. %.

These sheets A, B and C are subjected to different methods V1, V2, V3 for hardening. These methods V1, V2, V3 all have other heat treatments that follow a solution annealing at 540° C. (degrees Celsius) for 2 min (minutes) and a subsequent first accelerated cooling (namely water quenching).

Method V1 (Prior Art):

This method is known from the prior art, in which a thin sheet A, following the solution annealing and the first accelerated cooling, is subjected to a single-stage heat treatment. This single-stage heat treatment consists of a first holding with a first holding temperature (T1) at 100° C. and a first holding time (h1) of 7 days.

Figure 1:
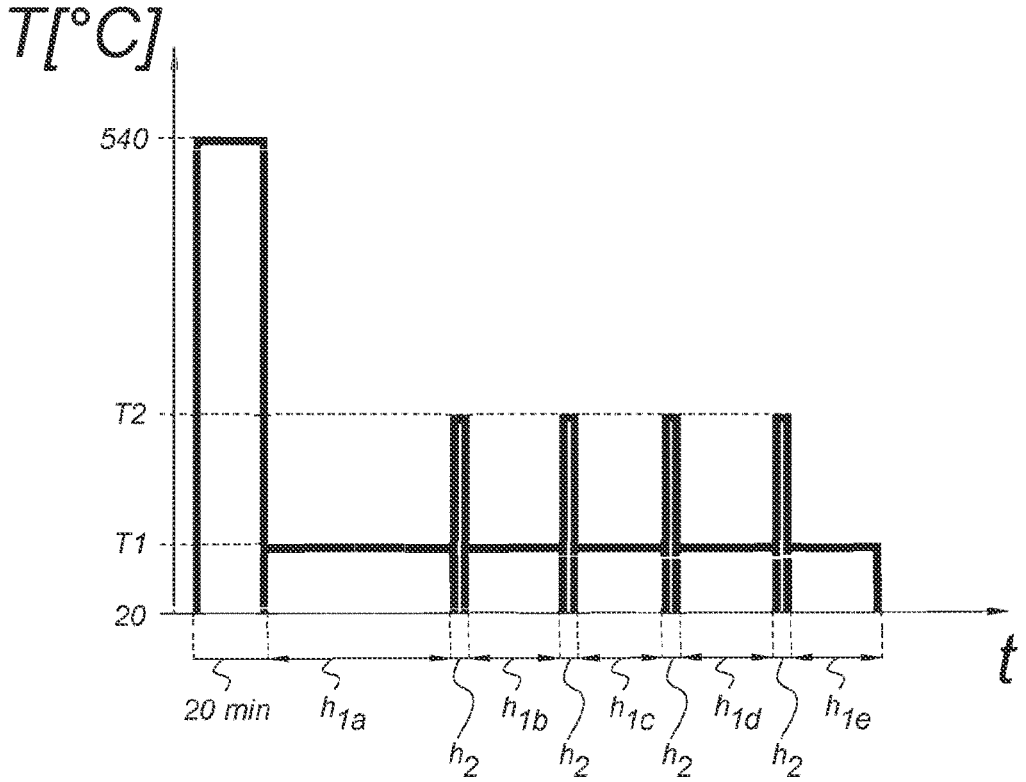
FIG. 1 shows a view of the sequence of a method for hardening a sheet or strip of an aluminum alloy.

In contrast to method V1, the heat treatments of methods V2, V3 according to the invention are multi-stage—as can be seen in FIG. 1.

This multi-stage is formed under a fourfold interruption of a first holding by a second holding together with a second accelerated cooling. As a result, the first holding is divided into holding stages.

On the one hand, these holding stages differ from one another in the first holding time sections h1a or h1b, h1c, h1d, h1e, and on the other hand they are identical in the first holding temperature T1, although the latter need not necessarily be the case. Each holding stage can have its individual holding temperature T1 during the individual first holding time section h1a, h1b, h1c, h1d or h1e. The first holding temperature T1 or first holding temperatures T1 of the first holding time sections h1a, h1b, h1c, h1d, h1e need only satisfy the condition of 60 to 140° C.

Method V2 (According to the Invention):

Thin sheet B was then subjected to multi-stage heat treatment in the following sequence after solution annealing and initial accelerated cooling:

a. first holding at a first holding temperature T1 at 100° C. during a first holding time interval h1a of 3 hours;
b. heating with introduction into a metal bath at a heating rate of more than 100° C./s (degrees Celsius per second) to a second holding temperature T2;
c. second holding at a second holding temperature T2 at 250° C. for a second holding time h2 of 12 seconds, wherein at a second holding time h2 and at a grain size KG of 50 μm the condition 11.35 seconds≤h2≤39.91 seconds is thus fulfilled;
d. second accelerated cooling with introduction into a metal bath at a cooling rate of 80° C./s to a room temperature (20° C.);
e. heating with introduction into an oil bath at a heating rate of 10° C./s to the first holding temperature T1;
f. first holding at a first holding temperature T1 at 100° C. during a first holding time section h1b or h1c or h1d or h1e of 1 hour;

with steps b to f then being repeated three times and, after these repetitions, the thin sheet B then being cooled to room temperature, optionally in an accelerated manner, as can be seen in FIG. 1.

Furthermore, it can be seen in FIG. 1 that the first holding time sections h1a, h1b, h1c, h1d and h1e last significantly longer than the second holding time h2 (cf. hour in relation to seconds).

Method V3 (According to the Invention):

Method V3 differs from method V2 exclusively in point c, in that the second holding is carried out at a second holding temperature T2 at 205° C. during a second holding time h2 of 45 seconds. This holding time also satisfies at a grain size KG of 50 μm the condition 28.82 seconds≤h2≤101.60 seconds.

The sheets A, B, C subjected to the methods V1, V2 and V3 for hardening were investigated by means of tensile tests with respect to their mechanical properties 0.2% proof stress $R_{p0,2}$, tensile strength $R_m$, uniform elongation $A_g$ and elongation at break A.

TABLE 1

Mechanical properties together with heat treament duration (HTD)

| Sheet | $R_{p0,2}$ [MPa] | $R_m$ [MPa] | $A_g$ [%] | A [%] | HTD |
|---|---|---|---|---|---|
| A | 222 | 331 | 22.8 | 28.4 | 7 days |
| B | 200 | 296 | 17.4 | 21.0 | 7 hours |
| C | 234 | 329 | 20.2 | 28.5 | 7 hours |

Figure 2:
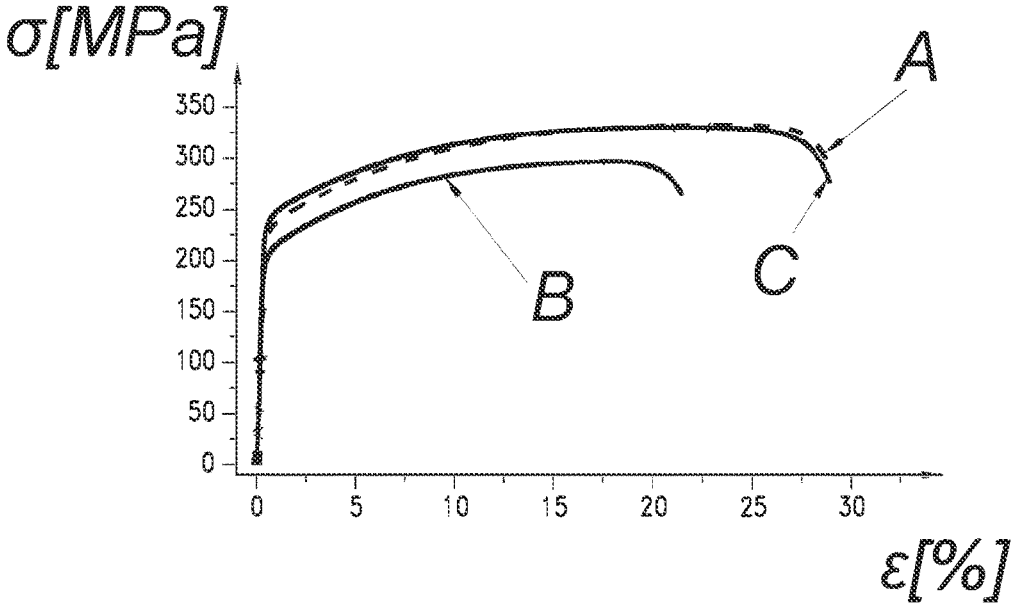
FIG. 2 shows a representation of mechanical properties of different sheets.

As can be seen from Table 1, sheets B, C achieve almost identical mechanical properties with significantly reduced hardening process times—as is the case with sheet A and can also be seen in FIG. 2.

In particular, compared with sheet A, sheet C even exhibits improved mechanical properties at the 0.2% proof stress, which are known to be achievable for sheet A only with an extremely long process time of 7 days.

Thus, a metallurgical examination of sheet B and C yielded the following results:

Sheet B:

Width of the precipitate-free zones at the grain boundaries 69 nm.

Mean size of $Mg_2Si$-type precipitates at grain boundaries 70 nm.

Sheet C:

Width of the precipitation-free zones at the grain boundaries 31 nm.

Mean size of $Mg_2Si$-type precipitates at grain boundaries 56 nm.

Cluster density of $2.55\times10^{24}$ clusters/$m^3$ with a median Guinier radius of 1.7 nm.

Compared to sheet B, sheet C exhibits both a small average size of precipitates and a smaller width of precipitate-free zones, which explains the increased strength values at higher strain values according to Table 1.

According to the invention, therefore, by means of methods V2 and V3, a significantly faster method for hardening 6xxx aluminum alloys can be created, with which outstanding elongation at break and tensile strength values can also be achieved due to the hardening of the aluminum alloy with the formation of essentially Mg—Si clusters.

In particular, at a lower second holding temperature (T2 at 205° C.) of method V3 compared to method V2, a significant improvement towards an optimum can be recognized, which lies in the range of 190 to 210° C.

In general, it is noted that "in particular" can be translated into English as "more particularly". A feature preceded by "in particular" is to be regarded as an optional feature which may be omitted and thus does not constitute a limitation, for example of the claims. The same applies to "vorzugsweise", translated into English as "preferably".

The invention claimed is:

1. A method for hardening a sheet or strip of an aluminum alloy of the 6xxx series, comprising the following steps:

solution annealing of the sheet or strip to form a solution annealed sheet or strip, a first accelerated cooling of the solution annealed sheet or strip to form a quenched sheet or strip; and a heat treatment of the quenched sheet or strip, wherein the heat treatment comprises:

a first holding at a first holding temperature (T1) in a range of 60 to 140° C., a second holding at a second holding temperature (T2) in a range from 150 to 250° C. during a second holding time (h2), and a subsequent second accelerated cooling, wherein the second holding with the subsequent second accelerated cooling interrupts the first holding a plurality of times and thereby divides the first holding into a plurality of first holding stages, each holding stage at the first holding temperature (T1) in the range from 60 to 140° C., and during a first holding time section (which includes two or more of h1a, h1b, h1c, h1d, h1e, etc.) which lasts longer than the second holding time (h2), wherein, as a result of the method, the sheet or strip has a 0.2% proof stress ($R_{p0,2}$)>200 MPa and an elongation at break (A) of >20%.

2. The method according to claim 1, wherein the first holding temperature (T1) is in a range of 80 to 120° C.

3. The method according to claim 1, wherein the first holding time sections (h1a, h1b, h1c, h1d, h1e) are less than or equal to 12 hours.

4. The method according to claim 1, wherein the second holding temperature (T2) is in a range of 170 to 230° C.

5. The method according to claim 1, wherein the second holding time (h2) of the second holding is less than or equal to 15 minutes.

6. The method according to claim 1, wherein the second holding time (h2) in seconds at a mean crystal grain size (KG) in micrometers and at the second holding temperature (T2) in degrees Celsius satisfies the following conditions:

$$h2 \geq (A1 + B1 \cdot KG) \cdot \exp\left(-\frac{T2}{C1}\right) + (D1 + E1 \cdot KG)$$

$$h2 \leq (A2 + B2 \cdot KG) \cdot \exp\left(-\frac{T2}{C2}\right) + (D2 + E2 \cdot KG)$$

with the following parameters

A1=−26400, B1=5000, C1=22.00, D1=1.25 and E1=0.15

A2=−125000, B2=29700, C2=20.75, D2=−0.55 and E2=0.65.

7. The method according to claim 1, wherein at least one of the following group of conditions applies:

a plurality of the first holding temperatures (T1) are equal, a plurality of the first holding time sections (h1a, h1b, h1c, h1d, h1e) are equal, and a plurality of the second holdings at the second holding temperature (T2) during the second holding time (h2) are equal.

8. The method according to claim 1, wherein the first and/or second accelerated cooling is performed at a cooling rate of at least 20° C./s.

9. The method according to claim 1, wherein heating from the first holding to the second holding is performed at a heating rate of at least 10° C./s.

10. The method according to claim 1, wherein the aluminum alloy comprises:

from 0.2 to 1.5 wt. % magnesium (Mg),
from 0.2 to 1.5 wt. % silicon (Si),
optionally
up to 1.1 wt. % Copper (Cu),
up to 0.7 wt. % iron (Fe),
up to 1.0 wt. % manganese (Mn),
up to 0.35 wt. % chromium (Cr),
up to 0.25 wt. % zinc (Zn),
up to 0.15 wt. % titanium (Ti),
up to 0.1 wt. % vanadium (V),
up to 0.2 wt. % zirconium (Zr),
up to 0.2 wt. % tin (Sn), and aluminum as a remainder, as well as impurities unavoidable in a production process.

11. The method according to claim 1, wherein the aluminum alloy is of type AA6005, AA6016, AA6061, AA6063 or AA6082.

12. The method according to claim 1, wherein the sheet or strip has a thickness of less than 5 mm.

* * * * *